US011592216B2

(12) United States Patent
Rahhal

(10) Patent No.: US 11,592,216 B2
(45) Date of Patent: Feb. 28, 2023

(54) LIQUID RECEIVER FOR HEATING, AIR CONDITIONING AND REFRIGERATION SYSTEM

(71) Applicant: Carrier Corporation, Palm Beach Gardens, FL (US)

(72) Inventor: Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/058,815

(22) PCT Filed: Sep. 12, 2018

(86) PCT No.: PCT/IB2018/001124

§ 371 (c)(1),
(2) Date: Nov. 25, 2020

(87) PCT Pub. No.: WO2020/053613

PCT Pub. Date: Mar. 19, 2020

(65) Prior Publication Data

US 2021/0207854 A1 Jul. 8, 2021

(51) Int. Cl.

| | |
|---|---|
| ***F25B 13/00*** | (2006.01) |
| ***F25B 41/31*** | (2021.01) |
| ***F25B 45/00*** | (2006.01) |

(52) U.S. Cl.

CPC ..... *F25B 13/00* (2013.01); *F25B 41/31* (2021.01); *F25B 45/00* (2013.01); *F25B 2313/02741* (2013.01); *F25B 2400/16* (2013.01)

(58) Field of Classification Search

CPC ..... F25B 13/00; F25B 41/31; F25B 45/00; F25B 2313/02741; F25B 2400/16

See application file for complete search history.

(56) References Cited

U.S. PATENT DOCUMENTS 4,272,970 A 6/1981 Hobbs
5,718,119 A * 2/1998 Wakita ..... F25B 45/00 62/85

(Continued)

FOREIGN PATENT DOCUMENTS

CN 1174315 A 2/1998
CN 202660826 U 1/2013

(Continued)

OTHER PUBLICATIONS

International Search Report for International Application No. PCT/IB2018/001124, International Filing Date: Sep. 12, 2018, dated May 21, 2019, 4 pages.

(Continued)

*Primary Examiner* — Kun Kai Ma
(74) *Attorney, Agent, or Firm* — Cantor Colburn LLP

(57) ABSTRACT

A receiver for a heating, air conditioning, and refrigeration system includes a tube extending along a tube axis from a first receiver end to a second receiver end opposite the first receiver end, and a single receiver port. The receiver port is configured as both a receiver inlet and a receiver outlet. A heating, air conditioning, and refrigeration system includes a compressor configured to compress a refrigerant flow, a refrigerant pathway configured to convey the refrigerant flow through the heating, air conditioning, and refrigeration system, and a receiver fluidly connected to the refrigerant pathway. The receiver includes a tube extending along a tube axis from a first receiver end to a second receiver end opposite the first receiver end, and a single receiver port. The receiver port is configured as both a receiver inlet and a receiver outlet, and is connected to the refrigerant pathway via the single receiver port.

15 Claims, 6 Drawing Sheets

(56) References Cited

U.S. PATENT DOCUMENTS

| | | | | |
|---|---|---|---|---|
| 5,937,671 | A | 8/1999 | Inoue et al. | |
| 6,742,355 | B2 | 6/2004 | Ichimura et al. | |
| 8,789,389 | B2 | 7/2014 | Ogasawara et al. | |
| 9,976,785 | B2 | 5/2018 | Goel et al. | |
| 2005/0160762 | A1* | 7/2005 | Mizutani | F25B 43/003 62/503 |
| 2015/0267951 | A1 | 9/2015 | Berg et al. | |
| 2016/0010906 | A1 | 1/2016 | Kaspar et al. | |
| 2017/0059219 | A1* | 3/2017 | Goel | F25B 13/00 |

FOREIGN PATENT DOCUMENTS

| | | | |
|---|---|---|---|
| CN | 104949405 | A | 9/2015 |
| CN | 105180513 | A | 12/2015 |
| CN | 205747605 | U | 11/2016 |
| CN | 207556037 | U | 6/2018 |
| EP | 2535668 | A1 | 12/2012 |
| JP | S485366 | U | 1/1973 |
| JP | 54004464 | A | 1/1979 |
| JP | S6170388 | A | 4/1986 |
| JP | H08303821 | A | 11/1996 |
| JP | H09236357 | A | 9/1997 |
| JP | 1163741 | A | 3/1999 |
| KR | 1020120098218 | A | 9/2012 |
| WO | 2014092064 | A1 | 6/2014 |
| WO | 2015064172 | A1 | 5/2015 |

OTHER PUBLICATIONS

Written Opinion for International Application No. PCT/IB2018/001124, International Filing Date: Sep. 12, 2018, dated May 21, 2019, 8 pages.

First Office Action for Chinese Application No. 201880094819.5 dated May 5, 2022.

* cited by examiner

LIQUID RECEIVER FOR HEATING, AIR CONDITIONING AND REFRIGERATION SYSTEM

CROSS REFERENCE TO RELATED APPLICATIONS

This application is a National Stage application of PCT/IB2018/001124, filed Sep. 12, 2018, the disclosure of which is incorporated herein by reference in its entirety.

BACKGROUND

Exemplary embodiments pertain to the art of heating, air conditioning, and refrigeration systems. More particularly, the present disclosure relates to receivers for heating, air conditioning, and refrigeration systems, such as heat pump systems.

In some heating, air conditioning and refrigeration systems, such as a reversible air to water heat pump, a receiver is often utilized to manage refrigerant charge in the heating, air conditioning, and refrigeration system. The receiver is connected to a refrigerant pathway of the heating, air conditioning, and refrigeration system via a receiver inlet and via a receiver outlet. When the heating, air conditioning, and refrigeration system is operating in a first mode, for example, a heating mode, the receiver is at a high pressure and is filled with a volume of liquid refrigerant. The liquid refrigerant enters the receiver from a condensing heat exchanger via the receiver inlet. The liquid refrigerant flows from the receiver to an expansion valve via the receiver outlet. In a second mode, a cooling mode, the receiver is at a relatively low pressure and is mostly filled with refrigerant vapor. The two-phase vapor and liquid refrigerant flows from the expansion valve into the receiver and then exits the receiver toward an evaporator heat exchanger.

BRIEF DESCRIPTION

In one embodiment, a receiver for a heating, air conditioning, and refrigeration system includes a tube extending along a tube axis from a first receiver end to a second receiver end opposite the first receiver end, and a single receiver port. The receiver port is configured as both a receiver inlet and a receiver outlet.

Additionally or alternatively, in this or other embodiments the receiver is closed at the first receiver end and the receiver port is located at the second receiver end.

Additionally or alternatively, in this or other embodiments the receiver is closed at the first receiver end and at the second receiver end, and the receiver port is located at a receiver sidewall between the first receiver end and the second receiver end.

Additionally or alternatively, in this or other embodiments the tube axis is linear from the first receiver end to the second receiver end.

Additionally or alternatively, in this or other embodiments at least a portion of the tube axis is curvilinear between the first receiver end and the second receiver end.

Additionally or alternatively, in this or other embodiments an outside tube diameter of the tube is one of 1.125" (28.575 mm), 1.375" (34.925 mm), 1.625" (41.275 mm), 2.125" (53.975 mm), 2.625" (66.675 mm) or 3.125" (79.375 mm).

Additionally or alternatively, in this or other embodiments the receiver is formed from a copper material.

In another embodiment, a heating, air conditioning, and refrigeration system includes a compressor configured to compress a refrigerant flow, a refrigerant pathway configured to convey the refrigerant flow through the heating, air conditioning, and refrigeration system, and a receiver fluidly connected to the refrigerant pathway. The receiver includes a tube extending along a tube axis from a first receiver end to a second receiver end opposite the first receiver end, and a single receiver port. The receiver port is configured as both a receiver inlet and a receiver outlet. The receiver is connected to the refrigerant pathway via the single receiver port.

Additionally or alternatively, in this or other embodiments the receiver is closed at the first receiver end and the receiver port is located at the second receiver end.

Additionally or alternatively, in this or other embodiments the receiver is closed at the first receiver end and at the second receiver end, and the receiver port is located at a receiver sidewall between the first receiver end and the second receiver end.

Additionally or alternatively, in this or other embodiments the tube axis is linear from the first receiver end to the second receiver end.

Additionally or alternatively, in this or other embodiments at least a portion of the tube axis is curvilinear between the first receiver end and the second receiver end.

Additionally or alternatively, in this or other embodiments an outside tube diameter of the tube is one of 1.125" (28.575 mm), 1.375" (34.925 mm), 1.625" (41.275 mm), 2.125" (53.975 mm), 2.625" (66.675 mm) or 3.125" (79.375 mm).

Additionally or alternatively, in this or other embodiments the receiver is formed from a copper material.

Additionally or alternatively, in this or other embodiments the receiver is located along the refrigerant pathway between a first heat exchanger of the heating, air conditioning, and refrigeration system and an expansion valve of the heating, air conditioning, and refrigeration system.

Additionally or alternatively, in this or other embodiments the flow of refrigerant along the refrigerant pathway is reversible.

Additionally or alternatively, in this or other embodiments a four way valve is located along the refrigerant pathway to selectably reverse the flow of refrigerant along the refrigerant pathway.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
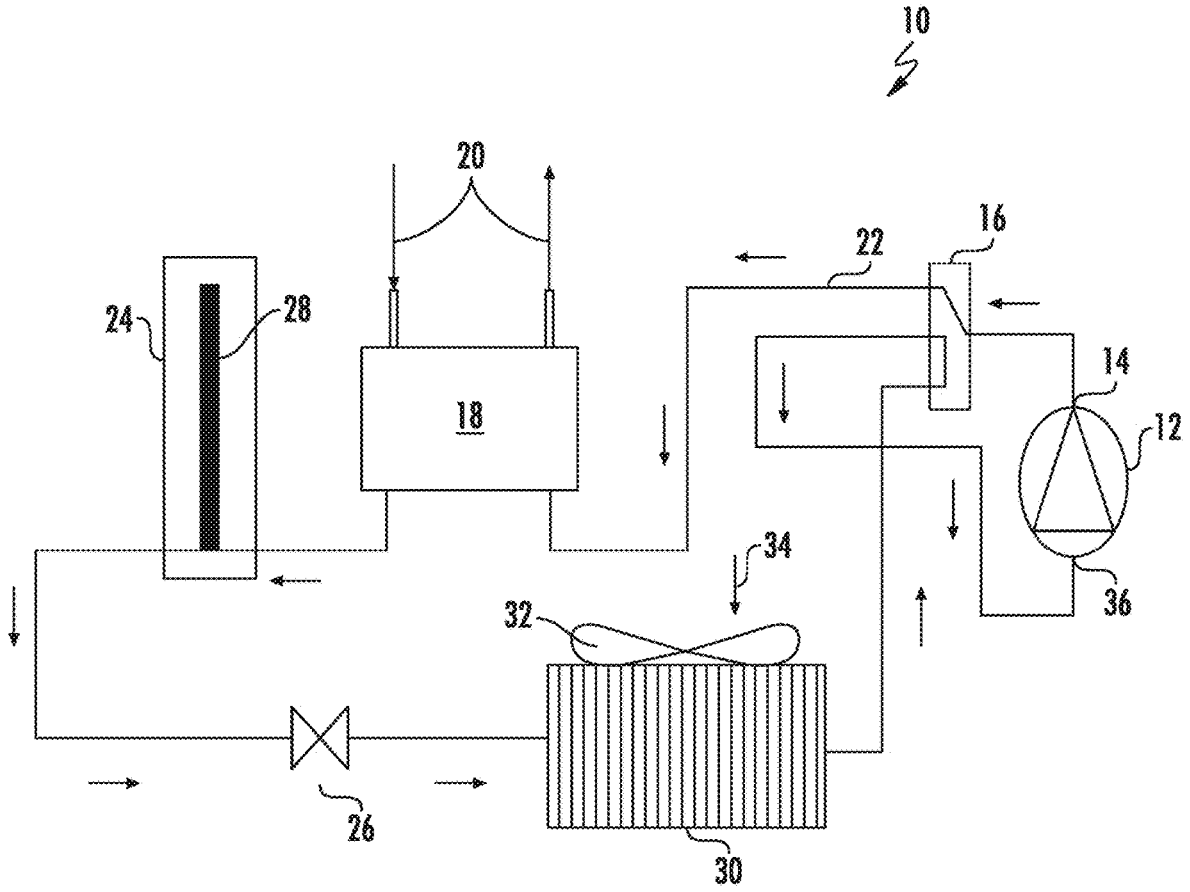
FIG. 1 is a schematic view of an embodiment of a heating, air conditioning, and refrigeration system operating in a first, heating mode.

Referring now to FIG. 1, shown is a schematic illustration of an embodiment of a heating, air conditioning, and refrigeration system 10, in this embodiment a reversible heat pump. The heating, air conditioning, and refrigeration system 10 includes a compressor 12 which outputs a compressed vapor refrigerant from a compressor outlet 14 toward a four way valve 16. In FIG. 1, the heating, air conditioning, and refrigeration system 10 is illustrated in a first mode, or heating mode, such that the compressed vapor refrigerant flows through the four way valve 16 toward a first heat exchanger 18 along a refrigerant pathway 22. In some embodiments, the first heat exchanger 18 is an indoor heat exchanger and may be, for example, a brazed plate heat exchanger. In the heating mode illustrated in FIG. 1, the first heat exchanger 18 is configured as a condenser, and the compressed vapor refrigerant exchanges thermal energy with a flow of thermal exchange fluid 20 at the first heat exchanger 18, thus heating the thermal exchange fluid 20 and causing the compressed vapor refrigerant to condense to a liquid.

A receiver 24 is located along the refrigerant pathway 22 downstream of the first heat exchanger 18, between the first heat exchanger 18 and an expansion valve 26. Excess liquid refrigerant 28 accumulates in the receiver 24. The expansion valve 26 partially vaporizes the liquid refrigerant flow and two-phase refrigerant flow flows from the expansion valve 26 to a second heat exchanger 30 along the refrigerant pathway 22. In some embodiments, the second heat exchanger 30 is an outside heat exchanger, and may be a tube and fin heat exchanger utilizing a fan 32 to urge an airflow 34 across the second heat exchanger 30 for thermal exchange with the refrigerant flowing therethrough. Refrigerant flow leaving the second heat exchanger 30 is returned to the compressor 12 at a compressor suction port 36 via the four way valve 16.

Figure 2:
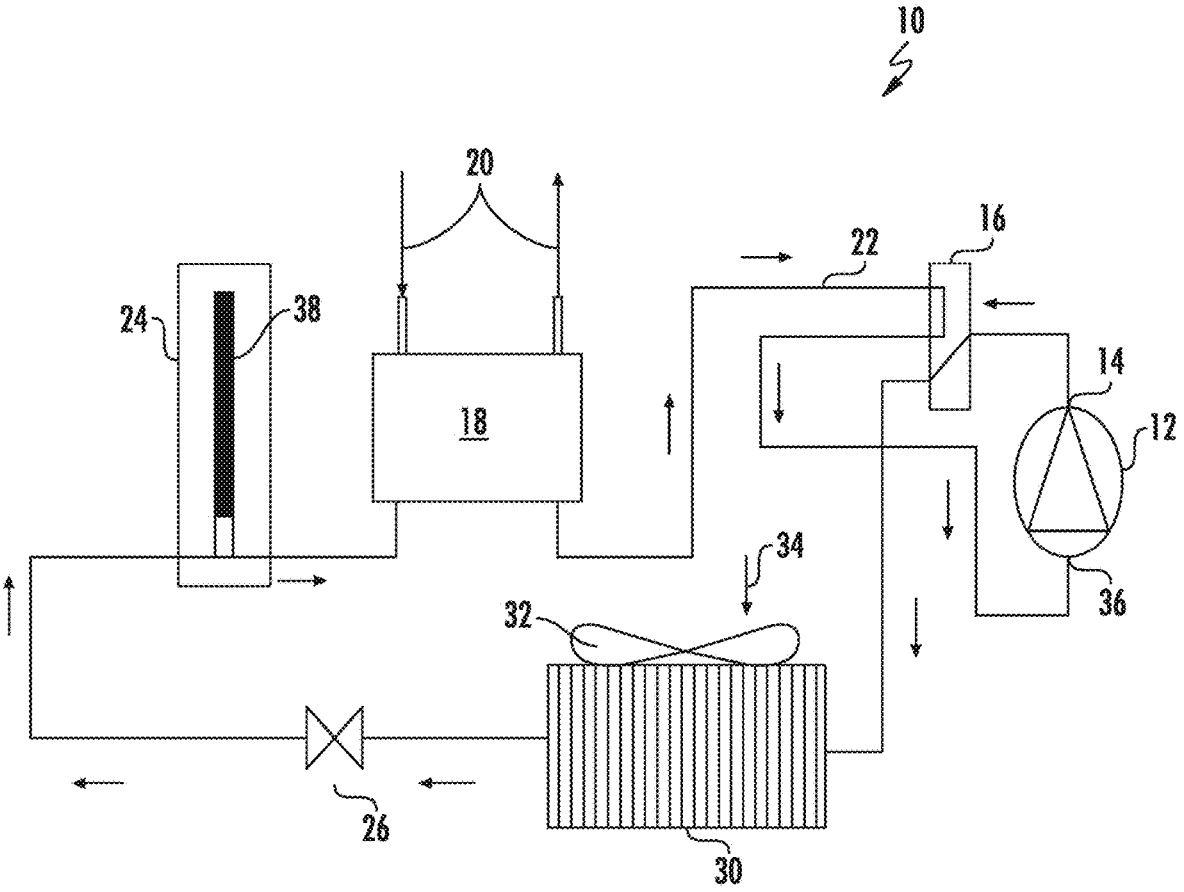
FIG. 2 is a schematic view of an embodiment of a heating, air conditioning, and refrigeration system operating in a second, cooling mode.

As illustrated in FIG. 2, the heating, air conditioning, and refrigeration system 10 may also be utilized in a second mode, a cooling mode. In the cooling mode, the flow of refrigerant from the four way valve 16 along the refrigerant pathway 22 is reversed, such that compressed vapor refrigerant leaving the compressor 12 flows from the four way valve 16 to the second heat exchanger 30, which in this mode is operating as a condenser. The liquid refrigerant output from the second heat exchanger 30 flows through the expansion valve 26 and is partially vaporized. The two-phase refrigerant is accumulated in the receiver 24, as mostly vapor refrigerant 38. The two-phase refrigerant flow then proceeds through the first heat exchanger 18, operating as an evaporator in cooling mode. The vapor refrigerant output from the first heat exchanger 18 is returned to the compressor suction port 36 via the four way valve 16.

Figure 3:
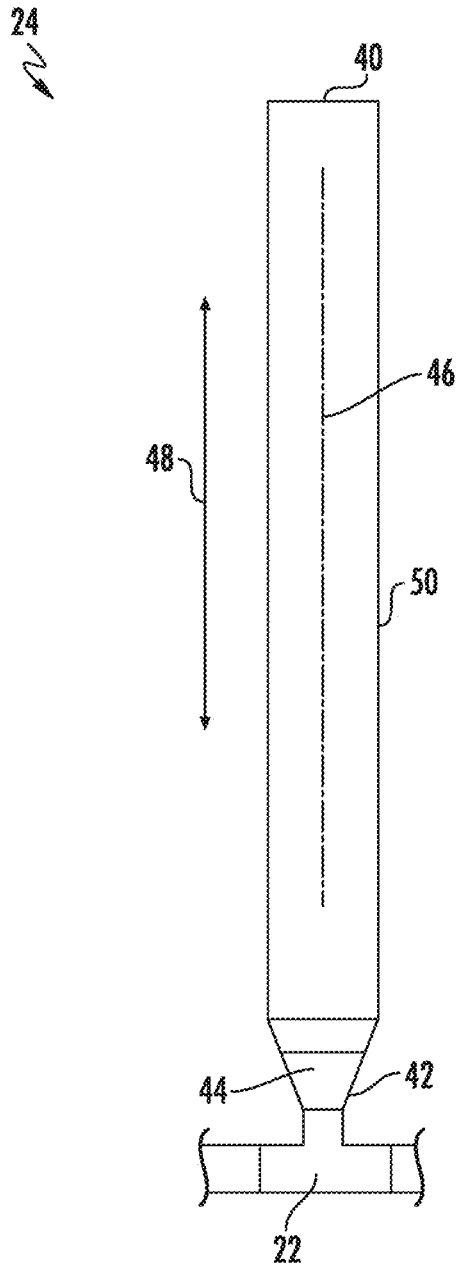
FIG. 3 illustrates an embodiment of a receiver for a heating, air conditioning, and refrigeration system.

Referring now to FIG. 3, an embodiment of the receiver 24 is illustrated. The receiver 24 is a tubular structure located vertically above the refrigerant pathway 22, and is located above a liquid line of the refrigerant pathway 22, such that there are no available pockets in the receiver 24 for the accumulation of excess fluids. The tubular structure is closed at a first end 40 and includes a single receiver port 42 connecting the receiver 24 to the refrigerant pathway 22. In some embodiments, such as the embodiment of FIG. 3, the receiver port 42 is located at a second end 44 of the receiver 24 opposite the first end 40. The receiver 24 is formed from, for example, a standard-sized tube having a selected diameter and length to achieve a selected receiver 24 volume. For example, the receiver 24 may be formed from, for example, tubing with an outside diameter of 1⅛" (28.575 mm), 1⅜" (34.925 mm), 1⅝" (41.275 mm), 2⅛" (53.975 mm), 2⅝" (66.675 mm) or 3⅛" (79.375 mm). In some embodiments, the tubing is a copper material. Construction of the receiver 24 utilizing standard-sized tubing results in a highly cost-effective receiver 24, which is highly customizable to a volume and/or orientation or configuration needed for a particular heating, air conditioning, and refrigeration system 10. The receiver 24 has a tube axis 46, which in the embodiment of FIG. 3 extends vertically along a receiver length 48.

Figure 4:
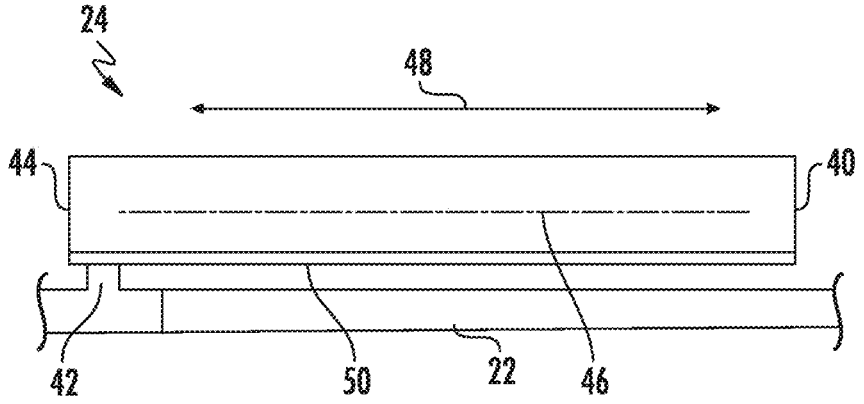
FIG. 4 illustrates another embodiment of a receiver for a heating, air conditioning, and refrigeration system.

While a receiver 24 with vertically-oriented, straight tube axis 46 is illustrated in FIG. 3, other embodiments of the receiver 24 may have other shapes and/or orientations. For example, in the embodiment of FIG. 4 the receiver 24 is oriented horizontally, with the receiver port 42 located in a receiver sidewall 50, rather than at the first end 40 or the second end 44. In the embodiment of FIG. 4, the tube axis 46 is straight and is oriented horizontally.

Figure 5:
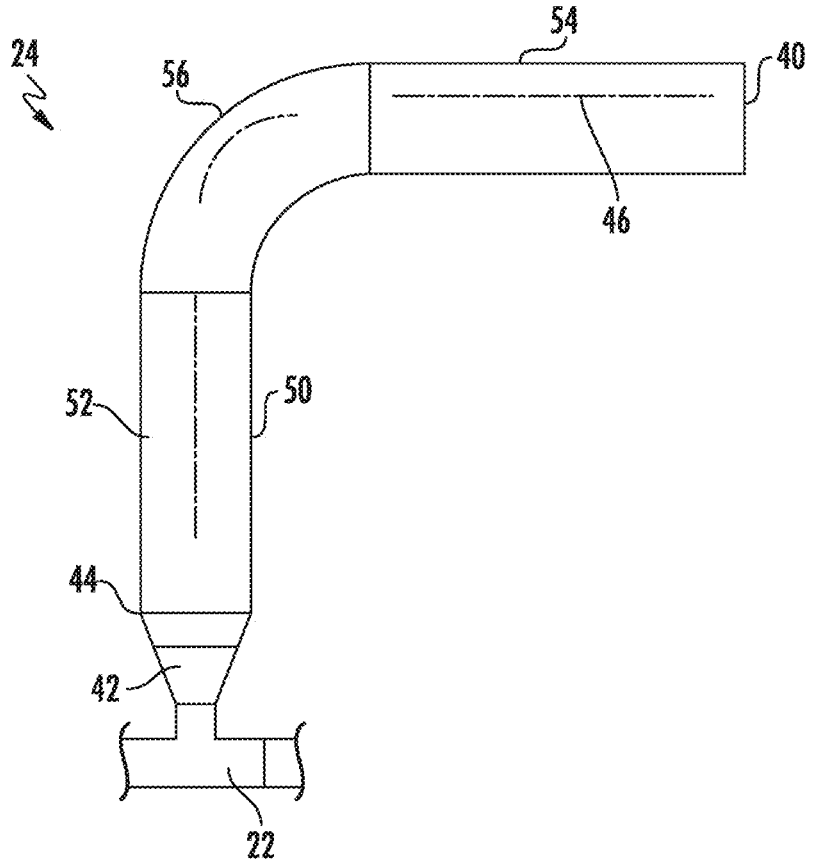
FIG. 5 illustrates yet another embodiment of a receiver for a heating, air conditioning, and refrigeration system.
Figure 6:
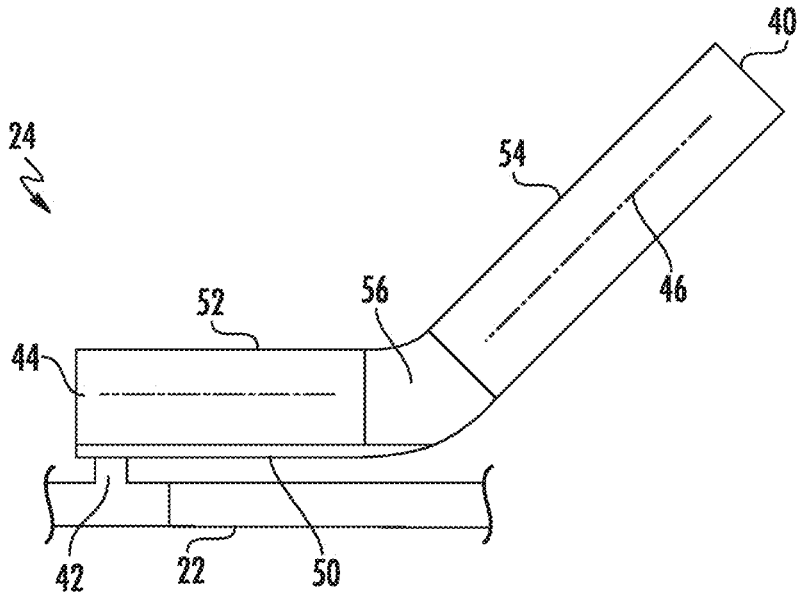
FIG. 6 illustrates still another embodiment of a receiver for a heating, air conditioning, and refrigeration system.
Figure 7:
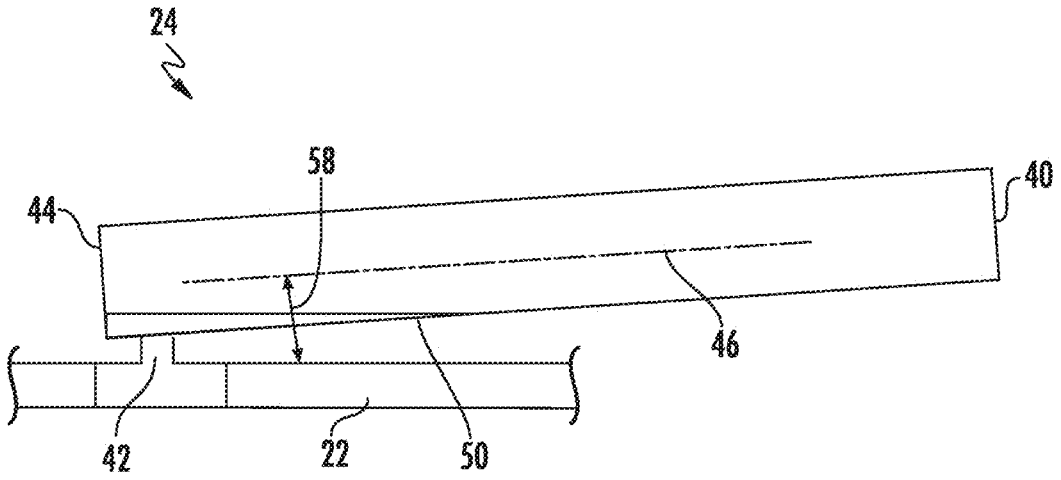
FIG. 7 illustrates another embodiment of a receiver for a heating, air conditioning, and refrigeration system.

Shown in FIG. 5 is another embodiment where the receiver port 42 is located at the first end 40 and the tube axis 46 extends vertically therefrom along a first portion 52 of the receiver 24. The receiver 24 also includes a second portion 54 at which the tube axis 46 is oriented horizontally. The first portion 52 and the second portion 54 are connected by a transition portion 56, at which the tube axis 46 is, for example, curvilinear as shown or alternatively may be linear but oriented neither vertically nor horizontally. In another embodiment shown in FIG. 6, the first portion 52 has a horizontally-oriented tube axis 46 and the receiver port 42 is located in the receiver sidewall 50. The receiver 24 includes the transition portion 56, and the second portion 54 extends from the transition portion 56, which is neither horizontal nor vertical. In another embodiment, illustrated in FIG. 7, the receiver port 42 is located in the receiver sidewall 50, and the tube axis 46 is straight and oriented at a tube angle 58 offset from horizontal. In some embodiments, the tube angle 58 is between about 0 degrees and 90 degrees. In addition to the shapes and configurations illustrated, other shapes and configurations, such as a spiral-shaped receiver 24 or other shapes are contemplated within the scope of the present disclosure.

Figure 8:
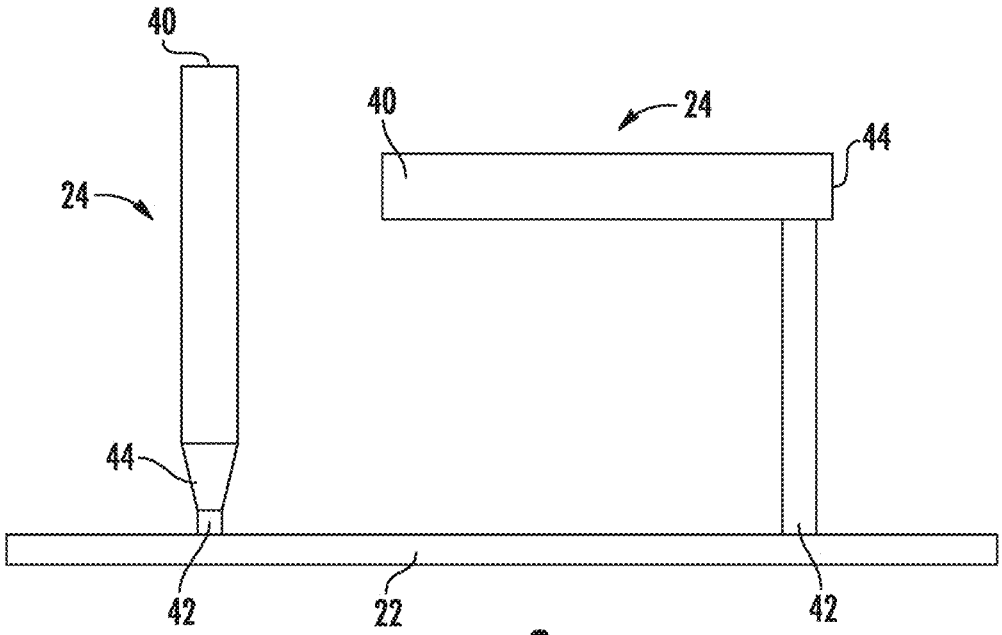
FIG. 8 illustrates an embodiment with multiple receivers connected to a refrigerant pathway.
Figure 9:
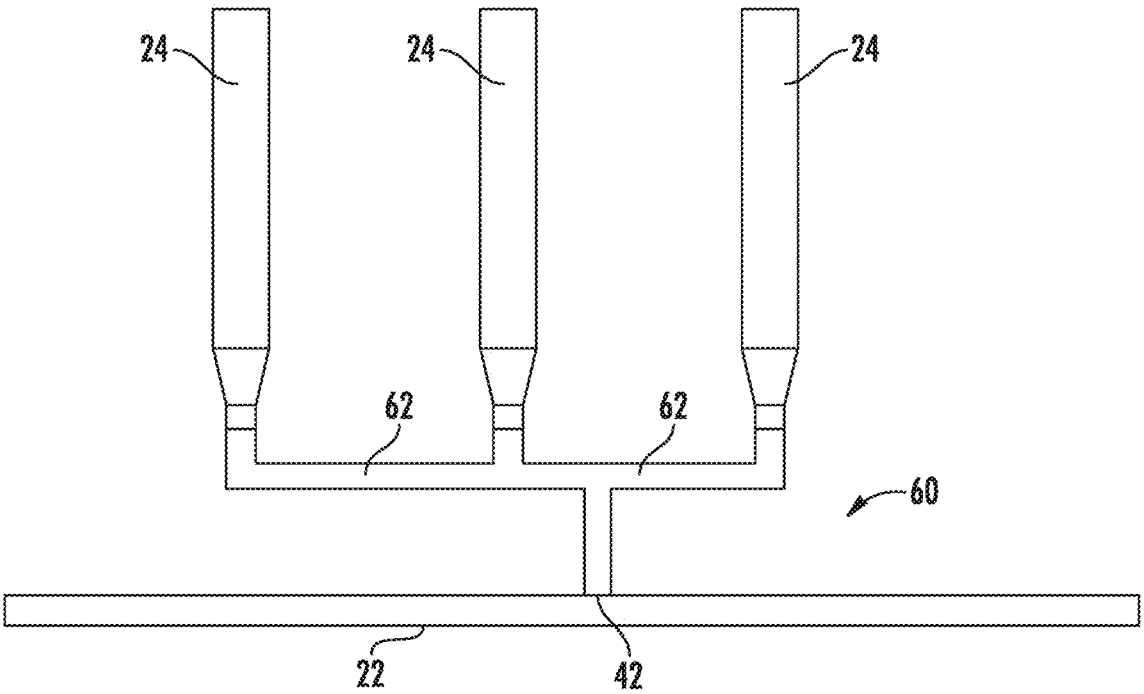
FIG. 9 illustrates an embodiment with multiple receivers connected to a refrigerant pathway via a manifold arrangement.

It is to be appreciated that while single receivers 24 are illustrated in FIGS. 3-7, in some heating, air conditioning, and refrigeration systems 10 multiple receivers 24 may be utilized. In one embodiment, shown in FIG. 8, two or more receivers 24 are connected to the refrigerant pathway 22 via separate receiver ports 42. The receivers 24 may be identical or of different configurations, sizes and/or orientations. In another embodiment, illustrated in FIG. 9, multiple receivers 24 are connected to the refrigerant pathway 22 at a common receiver port 42, through a manifold arrangement 60. A manifold pathway 62 extends from each receiver 24 and connects the receivers 24 to the refrigerant pathway 22 at the receiver port 42.

The receivers 24 disclosed herein formed from standard tubing reduces cost of the receiver 24 and the heating, air conditioning, and refrigeration system 10 compared to typical shell constructed receivers. Further, the refrigerant volume of the heating, air conditioning, and refrigeration system 10 may be reduced since the receiver 24 configuration may be more easily adapted and tuned depending on performance parameters of the heating, air conditioning, and refrigeration system 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A receiver for a heating, air conditioning, and refrigeration system, comprising:

a tube extending along a tube axis from a first receiver end to a second receiver end opposite the first receiver end; and a single receiver port, the single receiver port configured as both a receiver inlet and a receiver outlet;

wherein the tube axis includes a first linear portion, a second linear portion, and a curvilinear portion connecting the first linear portion to the second linear portion.

2. The receiver of claim 1, wherein the receiver is closed at the first receiver end and the single receiver port is disposed at the second receiver end.

3. The receiver of claim, wherein the receiver is closed at the first receiver end and at the second receiver end, and the single receiver port is disposed at a receiver sidewall between the first receiver end and the second receiver end.

4. The receiver of claim 1, wherein the tube axis is linear from the first receiver end to the second receiver end.

5. The receiver of claim 1, wherein an outside tube diameter of the tube is one of 1.125" (28.575 mm), 1.375" (34.925 mm), 1.625" (41.275 mm), 2.125" (53.975 mm), 2.625" (66.675 mm) or 3.125" (79.375 mm).

6. The receiver of claim 1, wherein the receiver is formed from a copper material.

7. A heating, air conditioning, and refrigeration system, comprising:

a compressor configured to compress a refrigerant flow;

a refrigerant pathway configured to convey the refrigerant flow through the heating, air conditioning, and refrigeration system; and a receiver fluidly connected to the refrigerant pathway, the receiver including:

a tube extending along a tube axis from a first receiver end to a second receiver end opposite the first receiver end; and a single receiver port, the single receiver port configured as both a receiver inlet and a receiver outlet, the receiver connected to the refrigerant pathway via the single receiver port;

wherein the tube axis includes a first linear portion, a second linear portion, and a curvilinear portion connecting the first linear portion to the second linear portion.

8. The heating, air conditioning, and refrigeration system of claim 7, wherein the receiver is closed at the first receiver end and the single receiver port is disposed at the second receiver end.

9. The heating, air conditioning, and refrigeration system of claim 7, wherein the receiver is closed at the first receiver end and at the second receiver end, and the single receiver port is disposed at a receiver sidewall between the first receiver end and the second receiver end.

10. The heating, air conditioning, and refrigeration system of claim 7, wherein the tube axis is linear from the first receiver end to the second receiver end.

11. The heating, air conditioning, and refrigeration system of claim 7, wherein an outside tube diameter of the tube is one of 1.125" (28.575 mm), 1.375" (34.925 mm), 1.625" (41.275 mm), 2.125" (53.975 mm), 2.625" (66.675 mm) or 3.125" (79.375 mm).

12. The heating, air conditioning, and refrigeration system of claim 7, wherein the receiver is formed from a copper material.

13. The heating, air conditioning, and refrigeration system of claim 7, wherein the receiver is disposed along the refrigerant pathway between a first heat exchanger of the heating, air conditioning, and refrigeration system and an expansion valve of the heating, air conditioning, and refrigeration system.

14. The heating, air conditioning, and refrigeration system of claim 7, wherein the flow of refrigerant along the refrigerant pathway is reversible.

15. The heating, air conditioning, and refrigeration system of claim 14, further comprising a four way valve disposed along the refrigerant pathway to selectably reverse the flow of refrigerant along the refrigerant pathway.

* * * * *